US006661381B2

(12) United States Patent
Chen

(10) Patent No.: US 6,661,381 B2
(45) Date of Patent: Dec. 9, 2003

(54) CIRCUIT-BOARD ANTENNA

(75) Inventor: Po-Chao Chen, Taipei (TW)

(73) Assignee: SmartAnt Telecom Co., Ltd., Hsinchu (TW)

( * ) Notice: Subject to any disclaimer, the term of this patent is extended or adjusted under 35 U.S.C. 154(b) by 0 days.

(21) Appl. No.: 10/136,288

(22) Filed: May 2, 2002

(65) Prior Publication Data

US 2003/0206135 A1 Nov. 6, 2003

(51) Int. Cl.[7] ..... H01Q 1/36
(52) U.S. Cl. ..... 343/700 MS; 343/795
(58) Field of Search ..... 343/700 MS, 795, 343/846, 848

(56) References Cited

U.S. PATENT DOCUMENTS 4,987,424 A * 1/1991 Tamura et al. ..... 343/795
5,949,383 A * 9/1999 Hayes et al. ..... 343/795
6,337,667 B1 * 1/2002 Ayala et al. ..... 343/795
6,417,816 B2 * 7/2002 Sadler et al. ..... 343/795
6,501,436 B1 * 12/2002 Saito et al. ..... 343/867
6,512,487 B1 * 1/2003 Taylor et al. ..... 343/795
6,529,170 B1 * 3/2003 Nishizawa et al. ..... 343/795

* cited by examiner

*Primary Examiner*—Tan Ho
(74) *Attorney, Agent, or Firm*—Birch, Stewart, Kolasch & Birch, LLP

(57) ABSTRACT

A circuit-board antenna has a standing wave resonance which is utilized to extend the radiation end of a dipole antenna as its radiation length, e.g. (n+¼) times the wavelength. Half the wavelength in the radiation direction of the dipole antenna is designed to be twisted, the radiation from which cancels with itself, resulting in a radiation gain in the radiation direction. A circuit board is used to make such a dipole antenna. It can conveniently achieve the goal of self cancellation for radiation from the twisty part. The radiation orientation of the antenna can be adjusted to be upward or downward by modifying the extension length between the radiation end and the ground end of the dipole antenna.

12 Claims, 8 Drawing Sheets

CIRCUIT-BOARD ANTENNA

BACKGROUND OF THE INVENTION

1. Field of Invention

The invention relates to an antenna and, in particular, to a circuit-board antenna.

2. Related Art

Due to continuous development in communications technology, communication products are very common in daily life. Therefore, the demand for higher mobile communication quality becomes stronger. To obtain high-quality mobile communications, the antenna design in addition to better communication systems is also very important.

The conventional dipole antenna design is usually a ½-wavelength (λ) structure (see FIG. 1). In FIG. 2, however, the open end 11 of the signal part 10 in the dipole antenna is designed to be (1+¼)λ and the open end 21 of the ground end 20 is designed to be ¼λ. The first radiation section 111 and the third radiation section 113 are radiating in the same direction, whereas the second radiation section 112 is radiating in the opposite direction, canceling with the radiation from the first and third radiation sections 111, 113. This changes the electromagnetic (EM) field shape of the antenna and therefore cannot increase its gain.

In this situation, increasing the length of the antenna is unable to effectively increase the gain. Therefore, existing dipole antennas are all designed in a symmetric way and the gain cannot be increased. However, for modern wireless communications, it is of great importance to enhance the antenna gain. How to extend the current antenna designs into those with higher gains has become a significant research field.

SUMMARY OF THE INVENTION

In view of the foregoing, it is an objective of the invention to provide a circuit-board antenna device, which has a higher radiation gain and adjusts to give better radiation orientation.

To achieve the above objective, the invention provides a circuit-board antenna, which can radiate and receive EM waves with a particular wavelength and is capable of increasing the radiation gain. The invention includes a circuit board, a signal part with an open end, and an open part with a ground. The circuit board has an upper surface and a lower surface. The signal part is formed on the upper surface of the circuit board. The open end is comprised of a plurality of radiation sections and a plurality of twisty sections. The path length of the open end is (n+¼) times the particular wavelength, where n is a non-negative integer. Each of the twisty section is positioned between two of the radiation sections. The plurality of radiation sections are comprised of some radiation sections with a length of ¼ times the particular wavelength while the rest with a length of ½ times the particular wavelength. The radiation sections are used to radiate and receive EM waves of the particular wavelength. The path length of each of the twisty sections is ½ times the particular wavelength so that the EM waves thus generated cancel with themselves. The open part is formed on the lower surface of the circuit board. The path length of the open part is ¼ times the particular wavelength. Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will become more fully understood from the detailed description given hereinbelow and the accompanying drawings which are given by way of illustration only, and thus are not limitative of the present invention, and wherein.

DETAILED DESCRIPTION OF THE INVENTION

In order to increase the antenna gain, the invention makes a second radiation section 112 generate an opposite standing wave with a first radiation section 111 to self-cancel the radiation (see FIG. 2), so that the radiation end only has radiation in one direction, thus enhancing the antenna gain. A feature of the invention is to print the antenna on a normal circuit board (using conductive metal as its material). A radiation section with self-radiation cancellation can be manufactured in this way.

Figure 1:
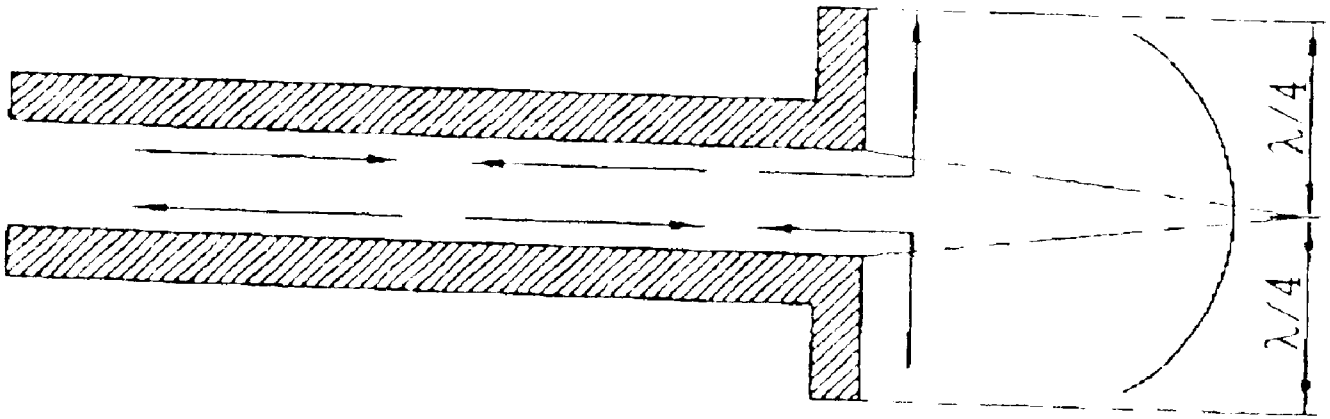
FIG. 1 (PRIOR ART)
FIG. 1 is a schematic view of a conventional ½λ dipole antenna.
Figure 2:
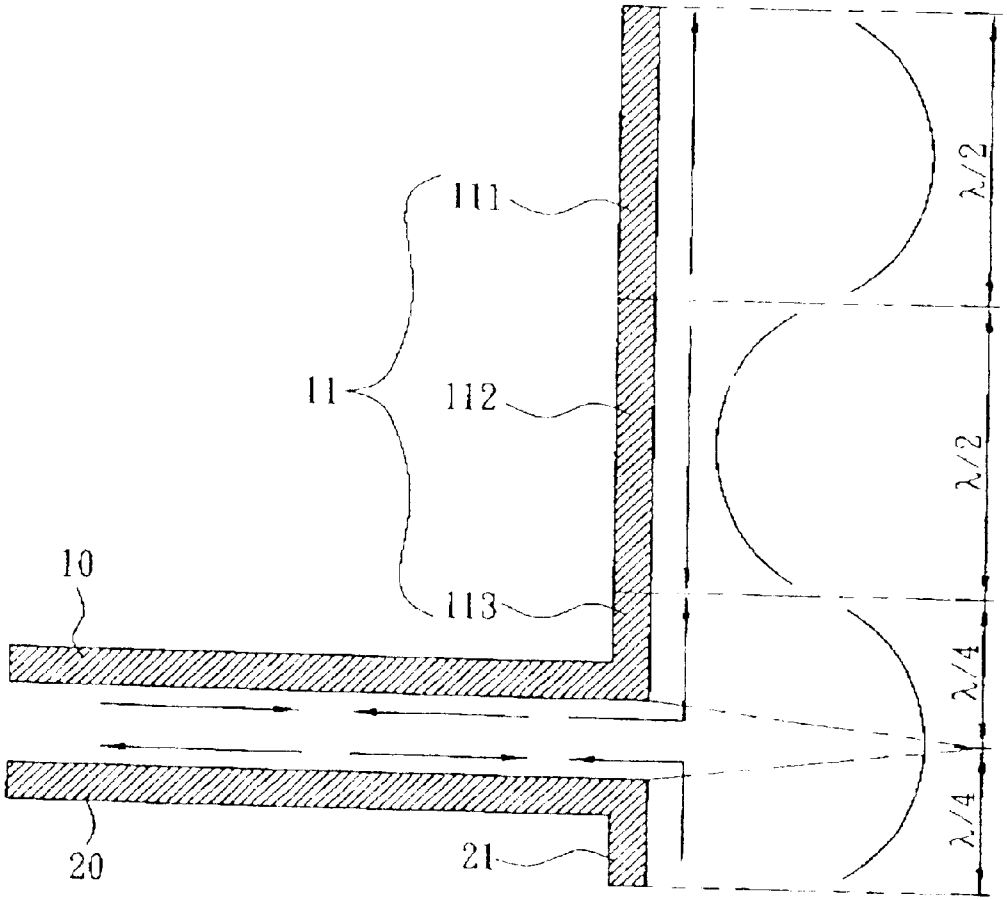
FIG. 2 (PRIOR ART)
FIG. 2 is another schematic view of a conventional ½λ dipole antenna.
Figure 3:
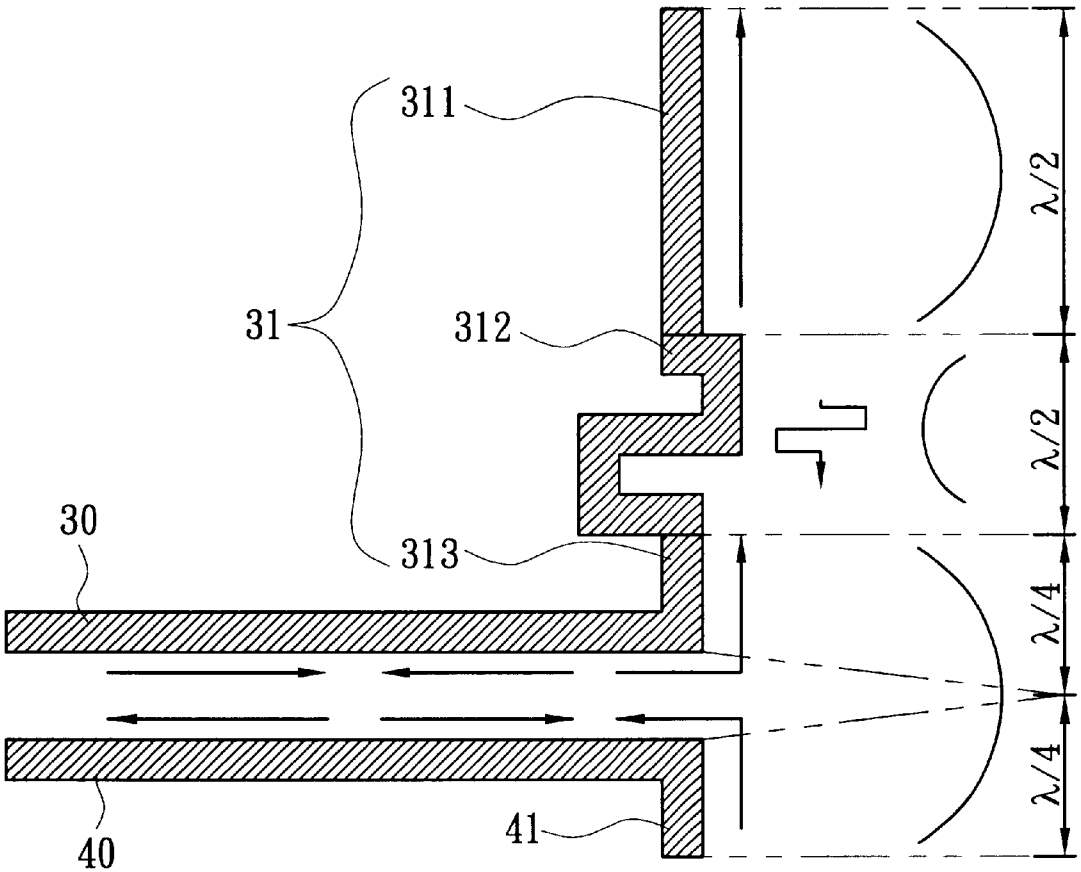
FIG. 3 is a schematic view of the disclosed circuit-board antenna device.

Please refer to FIG. 3 for an explicit example of making the invention. As the dipole antenna shown in FIG. 2, this antenna includes a signal part 30 and a ground 40. The second radiation section in FIG. 2 is designed as a twisty section 312 in FIG. 3. The first radiation section 311, the third radiation section 313, and the open end 41 of the ground 40 in this case are exactly the same of those in FIG. 2. The shape shown in the drawing can be formed using the circuit board fabricating method, so that the radiation from the twisty section 312 can achieve self-cancellation.

Since the twisty section 312 in FIG. 3 is made into a twisty shape, the opposite standing wave generated by the second radiation section 112 relative to the first radiation section 111 and the third radiation section 113 in FIG. 2 cancels exactly. Therefore, the first radiation section 311, the third radiation section 313, and the open end 41 of the ground 40 in FIG. 3 produce radiation in the same direction. Therefore, the antenna forms an array of two elements. This method can increase the antenna gain and the signal transmission distance.

Figure 4:
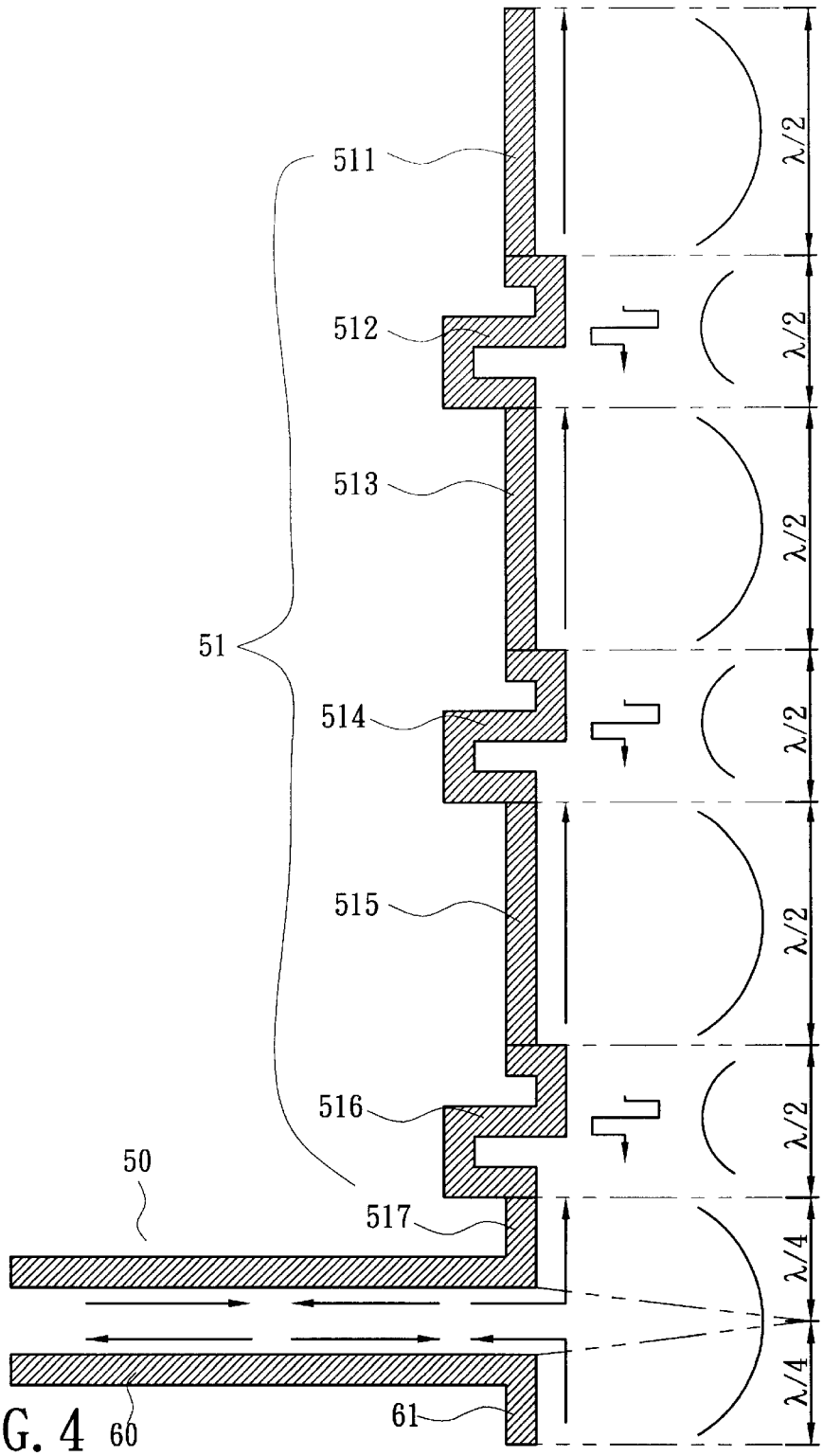
FIG. 4 is a schematic view of a (3+½)λ circuit-board antenna of the invention.

Extending the concept introduced in FIG. 3, the open end 31 of the signal part 30 can be elongated to further enhance the antenna radiation gain. In FIG. 4, the (1+½)λ-long antenna in FIG. 3 is extended into a (3+½)λ-long antenna including the signal part 50 and its open end 51, and the ground 60 and its open end 61. In the drawing, the increased 2λ-long antenna is also twisted into a fourth twisty section 514 and a sixth twisty section 516. The other two sections, i.e. the fifth radiation section 515 and the seventh radiation section 517 form a radiation section radiating in the same direction as the first radiation section 511 and the third radiation section 513. This can extend the radiation section, producing an array with more elements. Similarly, the embodiment in FIG. 4 is prepared using a circuit board.

From FIG. 4, we know that the design of twisty sections can increase the antenna gain without the problem of self-cancellation. Therefore, we can make an antenna with any desired gain. Moreover, such a twisted design can be used in an arrayed antenna.

Figure 5:
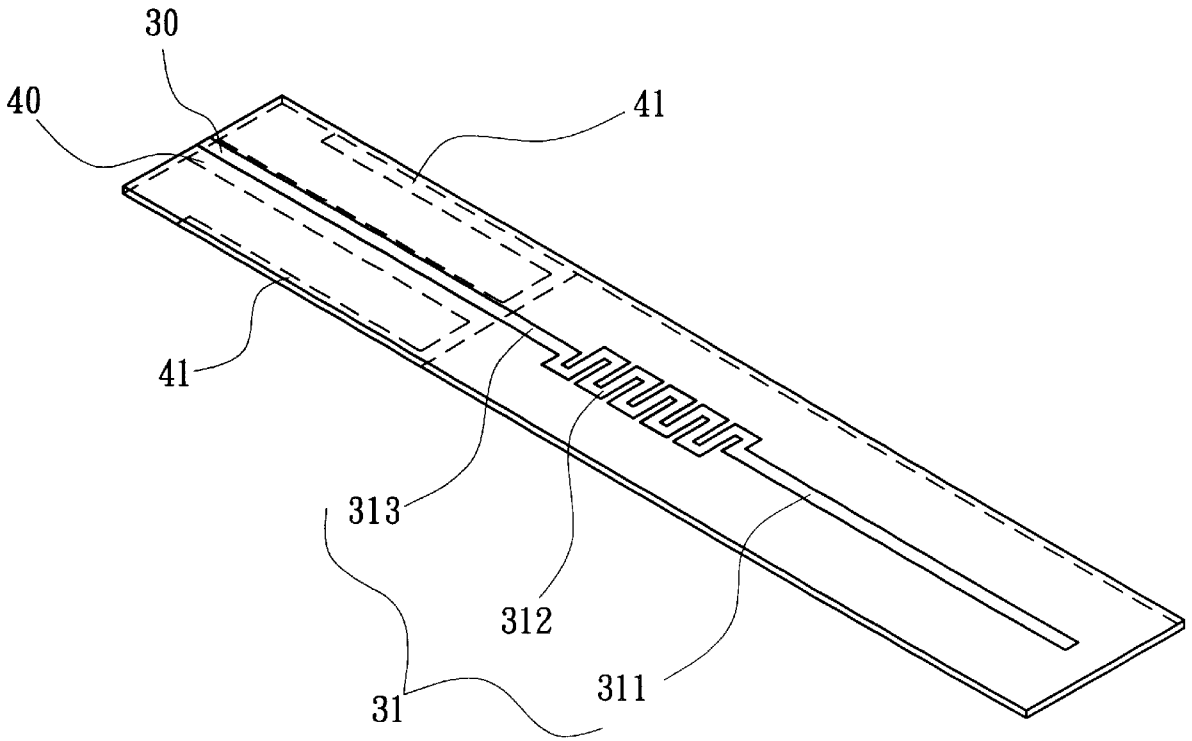
FIG. 5 shows a first embodiment of the invention.
Figure 6:
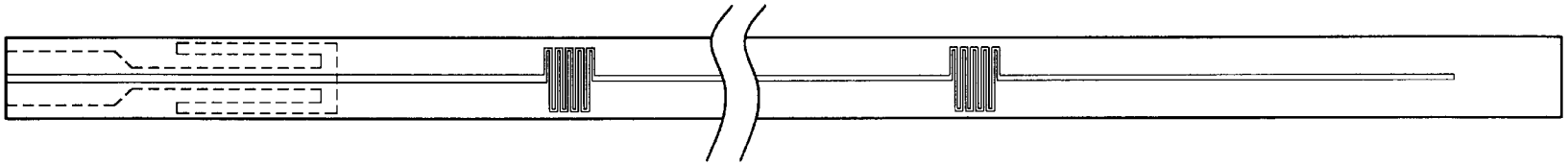
FIG. 6 shows a second embodiment of the invention.

For an explicit example of making antennas, please refer to FIG. 5 where various parts of an antenna are formed on a circuit board. FIG. 6 shows an effective circuit of FIG. 4. The very same method can be employed to extend the signal part or the open end of the ground to increase the antenna gain.

Figure 7A:
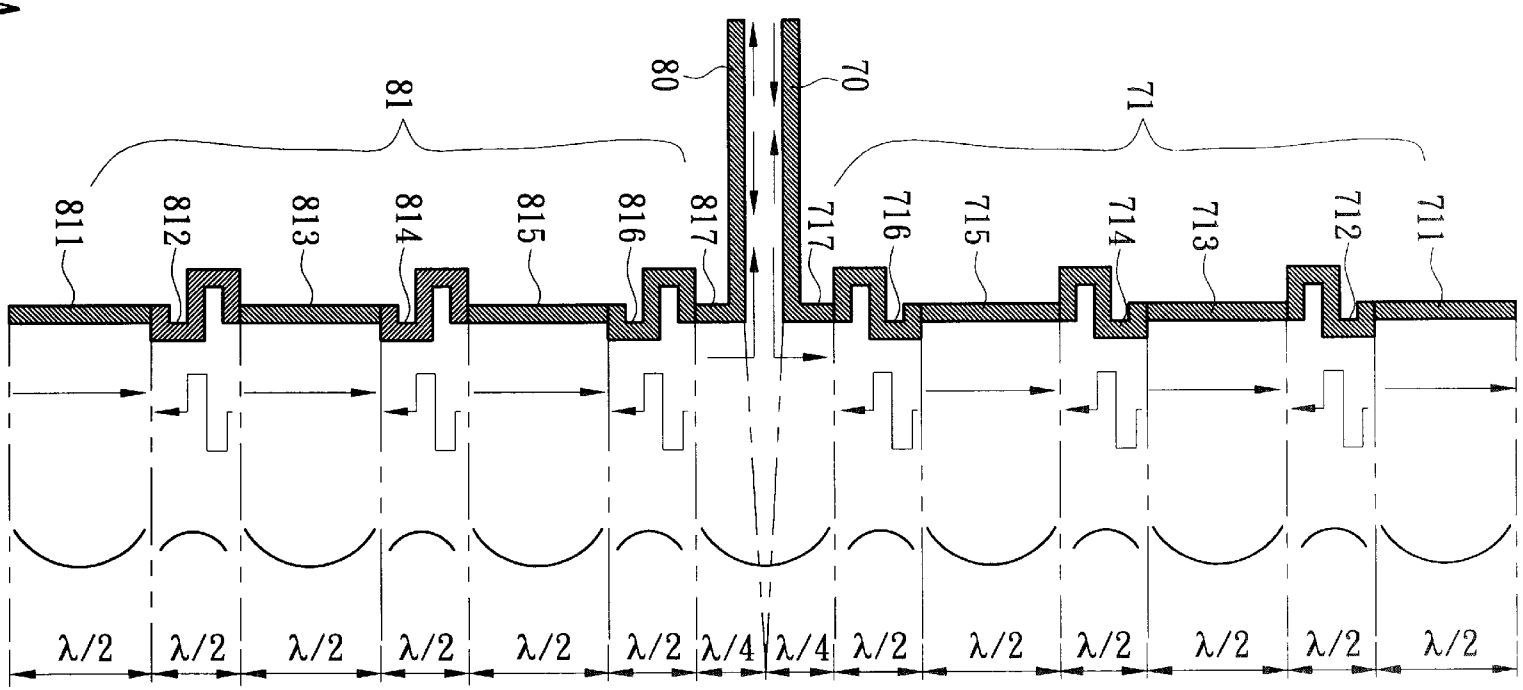
FIGS. 7A and 7B show a third embodiment of the invention.
Figure 7B:
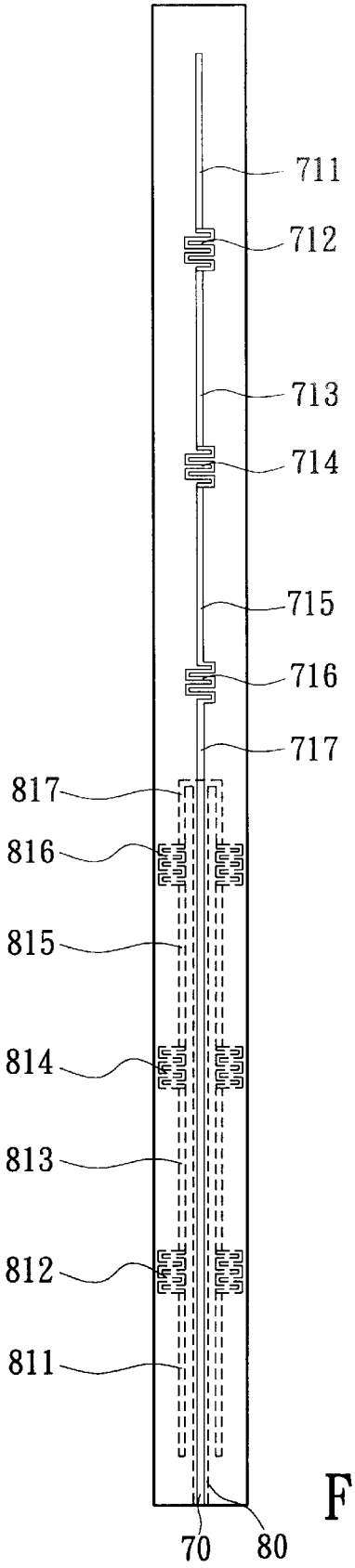

FIG. 7A shows an embodiment of extending both ends of a dipole antenna. The open end 71 of the signal part 70 contains first, third, fifth and seventh radiation sections 711, 713, 715, 717, and second, fourth and sixth radiation sections 712, 714, 716. The open end 81 of the ground 80 contains first, third, fifth and seventh radiation sections 811, 813, 815, 817, and second, fourth and sixth radiation sections 812, 814, 816. The effective circuit made of a circuit board is shown in FIG. 7B.

In practice, one can adjust the number of downward (open end of the ground) or upward (open end of the signal part) extensions to adjust the orientation of the antenna field shape. When the number of upward extending radiation sections is greater than that of the downward extensions ($n>m$), the radiation direction of the antenna is changed downwards. On the other hand, when the number of upward extending radiation sections is smaller than that of the downward extensions ($n<m$), the radiation direction of the antenna is changed upwards.

Effects of the Invention

The disclosed circuit-board antenna device can achieve the goal of increasing the radiation gain and efficiency.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A circuit-board antenna for radiating and receiving electromagnetic (EM) waves of a wavelength and with an increased radiation gain, the antenna comprising:

a circuit board, which has an upper surface and a lower surface;

a signal part having an open end formed on the upper surface of the circuit board, the open end having a plurality of radiation sections and a plurality of twisty sections, each of whose path lengths being $(n+\frac{1}{4})$ times the wavelength where n is a positive integer, each of the twisty sections being positioned between two of the radiation sections; wherein the plurality of radiation sections is comprised of radiation sections with a length of ¼ times the wavelength and others with a length of ½ times the wavelength for radiating and receiving the EM waves of the wavelength, and each of the plurality of twisty sections has a path length of ½ times the wavelength to make the EM waves cancel by themselves; and a ground with a second open end formed on the lower surface of the circuit, the path length of the second open end being ¼ times the wavelength.

2. The antenna of claim 1, wherein the radiation section has a straight shape.

3. The antenna of claim 1, wherein the radiation section has a polygon shape.

4. The antenna of claim 1, wherein the open end has a straight shape.

5. The antenna of claim 1, wherein the open end has a symmetric π shape, both sides of which consisting successively of radiation and twisty sections of ½ times the wavelength long.

6. The antenna of claim 1, wherein the second open end has a straight shape.

7. The antenna of claim 2, wherein the second open end has a straight shape.

8. A circuit-board antenna for radiating and receiving electromagnetic (EM) waves of a wavelength and with an increased radiation gain, the antenna comprising:

a circuit board, which has an upper surface and a lower surface;

a signal part having an open end formed on the upper surface of the circuit board, the open end having a plurality of radiation sections and a plurality of twisty sections, each of whose path lengths being $(n+\frac{1}{4})$ times the wavelength where n is a non-negative integer, each of the twisty sections being positioned between two of the radiation sections; wherein the plurality of radiation sections is comprised of radiation sections with a length of ¼ times the wavelength and others with a length of ½ times the wavelength for radiating and receiving the EM waves of the wavelength, and each of the plurality of twisty sections has a path length of ½ times the wavelength to make the EM waves cancel by themselves; and a ground with a second open end formed on the lower surface of the circuit, the open end having a plurality of radiation sections and a plurality of twisty sections, each of whose path lengths being $(m+\frac{1}{4})$ times the wavelength where m is a positive integer, each of the twisty sections being positioned between two of the radiation sections; wherein the plurality of radiation sections is comprised of radiation sections with a length of ¼ times the wavelength and others with a length of ½ times the wavelength for radiating and receiving the EM waves of the wavelength, and each of the plurality of twisty sections has a path length of ½ times the wavelength to make the EM waves cancel by themselves;

wherein the radiation direction is downward for $n>m$ and upward for $n<m$.

9. The antenna of claim 8, wherein the radiation section has a straight shape.

10. The antenna of claim 8, wherein the radiation section has a polygon shape.

11. The antenna of claim 8, wherein the open end has a straight shape.

12. The antenna of claim 8, wherein the open end has a symmetric π shape, both sides of which consisting successively of radiation and twisty sections of ½ times the wavelength long.

* * * * *